US009827689B2

(12) United States Patent
Steinhilber et al.

(10) Patent No.: US 9,827,689 B2
(45) Date of Patent: Nov. 28, 2017

(54) SAFETY ILLUMINATION FOR A SLICING MACHINE THAT MONITORS THE STATE OF THE BLADE AND STOP PLATE

(71) Applicant: Bizerba SE & Co. KG, Balingen (DE)

(72) Inventors: Ralf Steinhilber, Balingen (DE); Holger Klinger, Haigerloch (DE); Rainer Seemann, Sigmaringen (DE); Michael Heck, Bisingen (DE); Markus Bodmer, Messstetten (DE)

(73) Assignee: BIZERBA SE & CO. KG, Balingen (DE)

( * ) Notice: Subject to any disclaimer, the term of this patent is extended or adjusted under 35 U.S.C. 154(b) by 0 days.

(21) Appl. No.: 15/170,968

(22) Filed: Jun. 2, 2016

(65) Prior Publication Data

US 2016/0354944 A1 Dec. 8, 2016

(30) Foreign Application Priority Data

Jun. 2, 2015 (EP) ..... 15001635

(51) Int. Cl.

| | |
|---|---|
| ***G08B 21/00*** | (2006.01) |
| ***B26D 7/22*** | (2006.01) |
| ***B26D 1/15*** | (2006.01) |
| ***B26D 5/26*** | (2006.01) |
| ***B26D 7/06*** | (2006.01) |

(52) U.S. Cl.

CPC ..... *B26D 7/225* (2013.01); *B26D 1/15* (2013.01); *B26D 5/26* (2013.01); *B26D 7/0616* (2013.01); *B26D 2210/02* (2013.01)

(58) Field of Classification Search

CPC ..... B26D 7/225
USPC ..... 340/679, 691.1, 691.4
See application file for complete search history.

(56) References Cited

U.S. PATENT DOCUMENTS 5,461,956 A * 10/1995 Petersen ..... B26D 1/16 83/221
5,649,463 A * 7/1997 Lindee ..... B26D 1/0006 83/174

FOREIGN PATENT DOCUMENTS

| | | |
|---|---|---|
| DE | 2936106 A1 | 3/1980 |
| DE | 3238966 A1 | 4/1984 |
| DE | 4125689 C1 | 8/1992 |
| GB | 687877 A | 2/1953 |

* cited by examiner

*Primary Examiner* — Jeffery Hofsass
(74) *Attorney, Agent, or Firm* — Leydig, Voit & Mayer, Ltd.

(57) ABSTRACT

A slicing machine for cutting slices of a food product includes a machine housing including a circular blade configured to rotate in a cutting plane, a stop plate configured to be move, by an adjustment device, perpendicular to the cutting plane, a carriage mounted such that it is movable parallel to the cutting plane, and a machine status display for displaying an actual status of the slicing machine.

15 Claims, 4 Drawing Sheets

SAFETY ILLUMINATION FOR A SLICING MACHINE THAT MONITORS THE STATE OF THE BLADE AND STOP PLATE

CROSS REFERENCE TO RELATED APPLICATIONS

Priority is claimed to European Patent Application No. EP 15 001 635.0, filed on Jun. 2, 2015, the entire disclosure of which is hereby incorporated by reference herein.

FIELD

The present invention relates to a safety illumination for a slicing machine for cutting slices of food products and to a method for operating such a safety illumination.

BACKGROUND

Slicing machines are used in actual practice to cut slices of food such as cold cuts, meat, or cheese. The rotating blade is a source of danger. If a user approaches a slicing machine, he may assume that the slicing machine and the blade of the slicing machine are in a safe state, as the machine is not in use. A safe state means the blade is not moving and the stop plate is in a zero position in order to fully cover the cutting edge of the blade. In such a safe state, the risk of injury by the blade due to unintentional touching of the blade is reduced. In practice, it is not guaranteed that a slicing machine, which is not in use, has been brought to a safe state. Especially after close of business, the slicing machine is cleaned by cleaning staff which may have no idea about the state of a slicing machine and just assume that the operating person put the slicing machine into a safe state before finishing work.

During operation, slicing machines as known in the art may indicate if the machine is switched on or off and may also indicate the thickness of slices which are cut from food products in a way to ease the operation. However, they provide no indication regarding a safe or unsafe state of the slicing machine.

SUMMARY

In an embodiment, the present invention provides a slicing machine for cutting slices of a food product. The slicing machine includes a machine housing including a circular blade configured to rotate in a cutting plane, a stop plate configured to be move, by an adjustment device, perpendicular to the cutting plane, a carriage mounted such that it is movable parallel to the cutting plane, and a machine status display for displaying an actual status of the slicing machine.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION OF PREFERRED EMBODIMENTS

Figure 1:
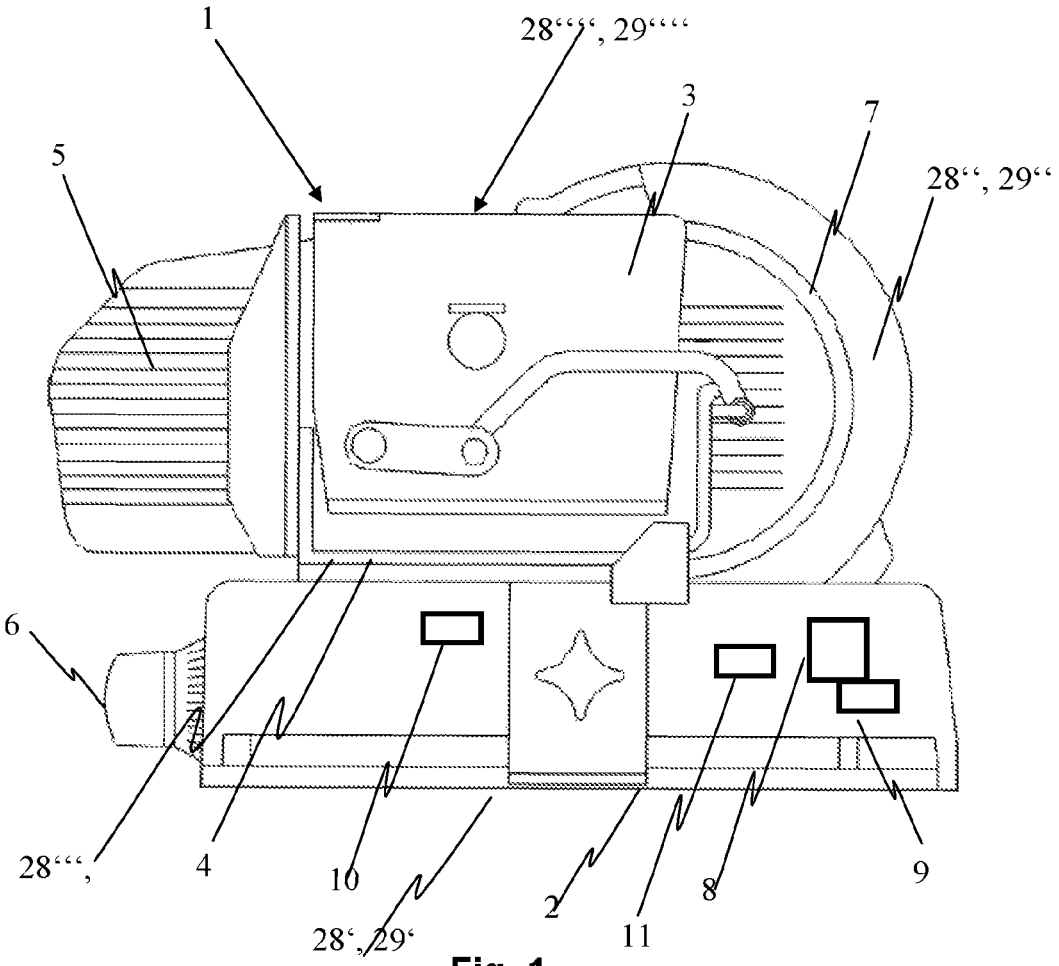
FIG. 1 schematically depicts a slicing machine according to an embodiment of the invention.

According to an embodiment, the present invention provides for enhanced slicing machines by providing an intuitive indication about the state of the machine in order to reduce the risk of injuries to persons operating or cleaning the slicing machines.

According to an embodiment, the present invention provides a slicing machine for cutting slices of a food product. The slicing machine comprises a machine housing. The machine housing comprises a circular blade rotating in a cutting plane. The circular blade is configured for cutting slices of food products. A stop plate, also known as gauge plate, is moveable perpendicular to the cutting plane. The stop plate is moved forth and back by an adjustment device. A carriage is mounted such that it is movable parallel to the cutting plane. The carriage is for carrying the food product to be sliced. The slicing machine comprises a machine status display for displaying the actual status of the slicing machine. The actual status of the machine is mainly related to its safety status. A slicing machine may or may not be in a safe state, in which the risk of injuries of operating or cleaning personal is reduced, e.g. if the cutting blade is not running and/or the stop plate is in a zero position. The slicing machine may or may not be in a less safe state, namely if the machine is in a fully operational mode when the blade is running and the stop plate is in a position such that the edge of the blade can be easily touched. The present invention has the advantage that a person approaching the slicing machine, even if the person is not part of trained personal knowing the risks of such machines very well, but instead is maybe part of a cleaning stuff not aware of the danger, easily and intuitively recognizes if there is a dangerous situation and if care need to be taken. Thus, the invention provides a safety illumination and enhances safety of a slicing machine.

According to one embodiment, the adjustment device for moving the stop plate is a knob. The knob consists at least partly of a transparent or translucent material. The machine status display is at least one light source which is integrated in the knob. The light source shines through the transparent or translucent material of the knob. This is advantageous as the knob is at a prominent position and a person approaching a slicing machine will see the knob and realizes the color of the light source in the transparent material of the knob.

According to one embodiment, a wire is guided through the axis of the cam plate of the slicing machine and through the inner area of the knob. The wire is for signaling to and supplying of the at least one light source. An electronic board for controlling the at least one light source is located in the knob. This has the advantage that no modifications are made to the slicing machine from the outside. The safety illumination and all means for operating the same are integrated in the slicing machine. Except from the transparent or translucent surface of the knob, no modifications to the surface of the slicing machine are necessary. Thus, the hygienic characteristic of the slicing machine is not affected, which is a key aspect for food processing machines.

According to one embodiment, the contact of the wire and the electronic board is established simply by soldering. According to one embodiment, the wire is connected to the electronic board by sliding contacts or a rotatable connection. As the electronic board is integrated in the knob and the knob will be rotated by the operating person during use in order to set the thickness of the slices to be cut, the electronic board will also rotate. If the wire is attached to the electronic board by a fixed connection, e.g. by soldering, there is a stress on the connection when the electronic board is rotating. Therefore, it is advantageous if the connection between the wire and the electronic board is realized by a rotatable connection, e.g. a rotatable connector or sliding contacts.

According to one embodiment, the electronic board comprises seven dual-light emitting diodes arranged in circular and equidistant manner. Each dual-light emitting diode provides light to an input of a light guiding structure. The light guiding structure is integrated in the transparent or translucent material of the knob. The light guiding structure is fracturing the light in a way that a homogeneous brightness or almost homogeneous brightness is provided in a sector of the outer periphery of the knob. If the electronic board comprises seven light emitting diodes arranged in the knob, seven light guiding structures are guiding the light from the diodes from the inside of the knob to the periphery of the knob. Each light emitting diode therefore illuminates a sector of the knob which is observable from the outside. The light guiding structures are arranged such that the sectors illuminated by each diode are neighboring each other and all together build a 360 degree illumination. Thus, the periphery of the knob is illuminated completely.

According to one embodiment, the slicing machine comprises feet attached to the bottom of the slicing machine for setting up the slicing machine on a flat surface. A flat surface is provided by a table on which the slicing machine is set or a cupboard or a sales counter. The machine status display is integrated as at least one light source in the bottom side of the slicing machine and shining onto the flat surface on which the slicing machine is set up. Thus, the machine status is displayed by indirect lighting.

According to one embodiment, the machine status display is integrated as at least one light source in a blade protection ring. This has the advantage that the blade protection ring is a big part of the machine at a very prominent position which will be recognized immediately by a person approaching the slicing machine. According to one embodiment, the machine status display is integrated as at least one light source in the carriage.

According to one embodiment, the machine status display is realized by covering at least one part of the slicing machine with a fluorescent material. Such fluorescent material emits light depending on a current or voltage being applied to a part covered by such fluorescent material. The coverage of the slicing machine itself is thus the light source.

According to one embodiment, the at least one light source is a light emitting diode or dual-light emitting diode covered by a transparent or translucent material. Dual light emitting diodes provide a different color depending on the bias voltage applied thereto and thus provide a possibility to signal different safety states. According to one embodiment, the dual-light emitting diode provides either green or red light. According to one embodiment, each light emitting diode as described above are in fact composed of a red light emitting diode and a green light emitting diode.

According to one embodiment, the slicing machine comprises a first determining means for determining if the blade is rotating. The slicing machine comprises a second determining means for determining the state of the stop plate. The machine status display provides at least a first display mode for indicating that the stop plate is in a zero position and the circular blade is not moving. This is a safe mode. If the blade is not moving, and the stop plate is in the zero position, hence covering one part of the blade, there is almost no risk of being injured, as the stop plate together with the blade protection ring covers almost the whole sharp edge of the blade. According to one embodiment, the machine status display is illuminated green if the slicing machine is in this safe state. The machine status display provides a second display mode for indicating that the stop plate is not in a zero position and the circular blade is not moving. This is not the safe mode in which the machine should be if not in use, e.g. over night. But in fact, if the blade is not moving, injuries if they happen are not that serious. Thus, there is a risk of injuries if the machine is in this state and care should be taken, but it is still a state where no immediate action is necessary. According to one embodiment, the machine status display is flashing red if the slicing machine is in this state. The machine status display provides a third display mode for indicating that the stop plate is not in a zero position and the circular blade is moving. This is a highly dangerous state, which is the state if the machine is fully operational. If an operating person works with the slicing machine, he is aware of the danger. But if cleaning stuff approaches the slicing machine, there might be no awareness about the danger coming from the machine. Thus, it is important that the person approaching the slicing machine is warned by the machine status display that the machine is in a dangerous state. According to one embodiment, the machine status display is illuminated red in the third display mode. It is intuitive that there is a need to take care when approaching the slicing machine.

According to one embodiment, a method for operating a safety illumination display for a slicing machine for cutting slices of a food product is proposed. The method comprises a first determining step for determining a state of a circular blade. The method further comprises a second determining step for determining a state of a stop plate. The method further comprises a generating step for generating a machine status value depending on the results of the first determining step and the second determining step. The method further comprises an illuminating step for illuminating a machine status display depending on the machine status value.

According to one embodiment, the step of illuminating a machine status display depending on the machine status value further comprises illuminating the machine status display in a first display mode if the first determining step determines that circular blade is not moving and the second determining step determines that the stop plate is in a zero position, and illuminating the machine status display in a second display mode if the first determining step determines that circular blade is not moving and the second determining step determines that the stop plate is in not a zero position, and illuminating the machine status display in a third display mode if the first determining step determines that circular blade is moving and the second determining step determines that the stop plate is in a zero position.

According to one embodiment, the machine status display is illuminated green in the first display mode, the machine status display is flashing red in the second display mode and the machine status display is illuminated red in the third display mode.

FIG. 1 shows a slicing machine 1 for slicing, i.e. cutting food products. The slicing machine 1 has a housing 2 in which a circular blade 3 and a carriage 4 are mounted. The circular blade 3 defines a cutting plane. Food products to be cut are located on the carriage 4. By moving the carriage 4 back and forth, the food products are cut by the circular blade 3 into slices. A stop plate 5 is oriented parallel to the circular blade 3 and hence parallel to the cutting plane. The stop plate 5 is movable perpendicular to the cutting plane by an adjustment device. According to one embodiment, the adjustment device is a knob 6 located at the outside of the housing 2. The knob 6 is rotatable by a user and by rotating the knob 6, the user defines a distance between the stop plate 5 and the cutting plane. This distance defines the thickness of the slices of food to be cut. The stop plate 5 has a zero position, which is an initial position. In the zero position, the surface of the stop plate 5 and the edge of the circular blade 3 are both located in the same plane, the cutting plane. This means, even if food is processed on the carriage 4 and the carriage 4 is moved back and forth, no slices are cut from the food product. In other words, the thickness of the slices would be zero and the surface of the food product moves exactly on the circular blade 3, but does not hit the edge of the circular blade 3. As soon as the stop plate 5 leaves the zero position, the stop plate 5 and the cutting plane are shifted with regard to each other by a certain distance. This distance corresponds to the thickness of the slices being cut by the slicing machine 1 when moving the carriage 4 back and forth. On the other hand, if a user accidentally touches the circular blade 3 when the stop plate 5 is in its zero position, it is almost impossible that the user touches the sharp edge of the circular blade 3 as there is no perpendicular distance between the stop plate 5 and the circular blade 3. If the stop plate 5 is not in its zero position, if a user slides with his finger above the stop plate 5, e.g. for cleaning the slicing machine 1, he may directly touch the sharp edge of the circular blade 3. This may lead to injuries. In one embodiment, the zero position of the stop plate 5 includes a negative offset position, meaning that the stop plate 5 is before the cutting plane such that a food product located on the carriage 4 would not even touch the circular blade 3. The slicing machine 1 comprises a second determining means 10 for determining the state of the stop plate 5. According to one embodiment, the second determining means 10 is a sensor detecting if the stop plate 5 reaches its zero position. According to one embodiment, the second determining means 10 is a sensor detecting the exact position of the stop plate 5. According to one embodiment, the second determining means 10 is a feedback loop from the knob 6 for adjusting the position of the stop plate 5 or a feedback loop from the controller executing the commands given by the knob 6 for controlling the stop plate 5. The slicing machine 1 further comprises a blade protection ring and a blade coverage 7 surrounding the edge of the cutting blade 3 in a C-shaped manner only leaving a small front area uncovered. The uncovered area of the edge of the circular blade 3 is for enabling the edge of the circular blade 3 to touch and cut the food product. In the housing 2 of the slicing machine 1, a motor 8 is present for rotating the circular blade 3. The motor 8 is controlled by a control logic and the status of the motor is retrieved by a first determining means 9, e.g. a sensor or feedback loop of the power supply of the motor 8 or a feedback of the control unit of the motor 8. The slicing machine 1 further comprises a processor 11. The processor 11 retrieves the outputs of the first determining means 9 and the second determining means 10. The processor 11 outputs a machine status value as described below. The machine status value is for controlling a machine status display 28, 29 arranged in the knob 6 and described in further detail below. According to one embodiment, the machine status display 28', 29' consisting of at least one electronic board 28' with light emitting diodes or dual-light emitting diodes and light guiding structures 29' is arranged in the bottom side of the slicing machine 1 for illuminating the surface on which the slicing machine 1 is installed. According to one embodiment, the machine status display 28", 29" is integrated in the blade protection ring and the blade coverage 7 surrounding the edge of the cutting blade 3. The blade protection ring and the blade coverage 7 comprise at least one electronic board 28" with light emitting diodes or dual-light emitting diodes and light guiding structures 29" for illuminating at least part of the blade protection ring and the blade coverage 7. According to one embodiment, the machine status display 28''', 29''' is integrated in the carriage 4. The carriage 4 comprises at least one electronic board 28''' with light emitting diodes or dual-light emitting diodes and light guiding structures 29''' for illuminating at least part of the carriage 4. According to one embodiment, other light sources are used instead of light emitting diodes, e.g. lasers. According to one embodiment, the machine status display 28'''', 29'''' is realized by coating at least part of the slicing machine 1, e.g. the blade protection ring and the blade coverage 7, the carriage 4, the housing 2 and/or the stop plate 5 by a fluorescent material which is stimulated electronically according to a determined display mode. According to one embodiment, the slicing machine 1 comprises a timer for determining how long the slicing machine 1 is not in use, e.g. how long the carriage 4 has not been moved in case the circular blade 3 is running and/or the stop plate 5 is not in a zero position. Depending on the timer, the light intensity of the machine status display and/or the frequency of the flashing is adapted in order to provide more information to the user.

Figure 2:
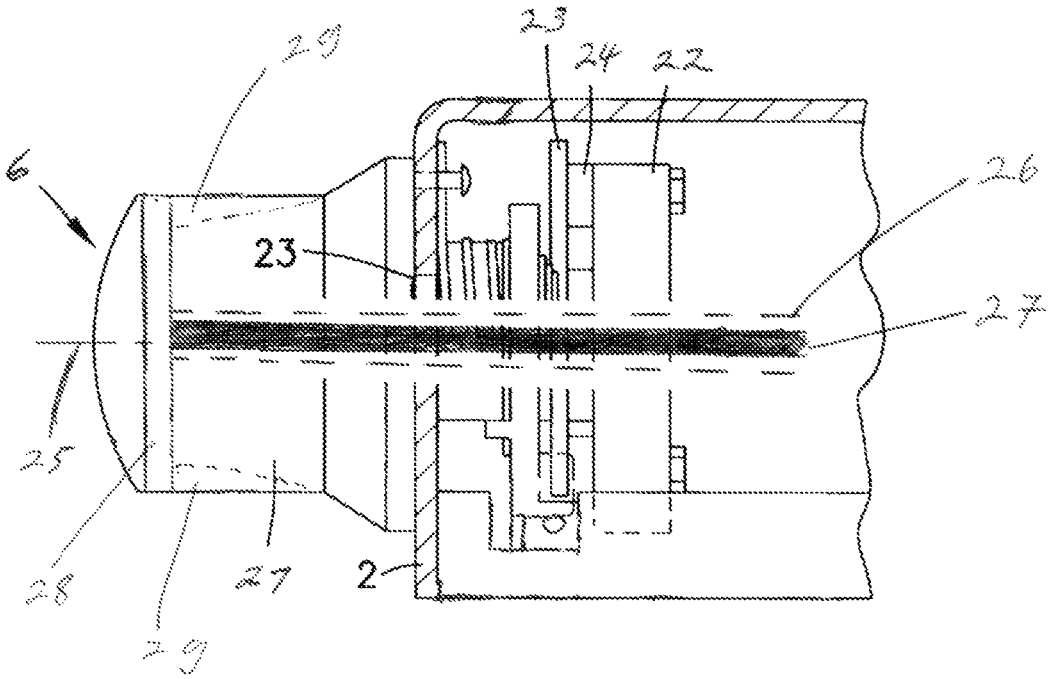
FIG. 2 schematically depicts a knob for moving a stop plate of a slicing machine according to an embodiment of the invention.

FIG. 2 schematically illustrates an adjustment device for moving the stop plate 5 perpendicular to the cutting plane and hence for adjusting the slice thickness. The adjustment device is realized as a knob 6. The desired slice thickness is set with a control handle 21. The control handle 21 is rigidly connected with a cam 22 and a locking disk 23, which is attached via a spacer ring 24, via the axle 25 mounted for rotation in the machine housing 2. The cam 22 is connected in addition with an adjusting device which is not illustrated and which converts the rotary movement of the cam 22 into a translatory movement of the stop plate 5 perpendicular to the cutting plane of the circular knife 3. On the axle 25 of the knob 6, an opening 26 is present providing a free space between the inner part of the knob 6 and the inner part of the housing 2. A cable connection, e.g. a wire 27 with multiple pins is arranged in the opening 26 for supplying an electronic board 28 arranged in the knob 6 and for signaling machine status values or output values of the first determining means 9 and the second determining means 10, which are arranged in the machine housing 2. The electronic board 28 arranged in the knob 6 is described in further detail below with regard to FIG. 3. The knob 6 further comprises light guiding structures 29, each one having an input which is in the proximity of the light emitting diodes or the dual-light emitting diodes arranged on the electronic board 28. The light guiding structure 29 fractions the light received at its input and provides a homogenous light or almost homogenous light in a sector at the outer surface of the knob 6. The machine status display is formed by the electronic board 28 and the light guiding structure 29 and is for displaying the actual status of the slicing machine 1 according to the determined machine status value.

Figure 3:
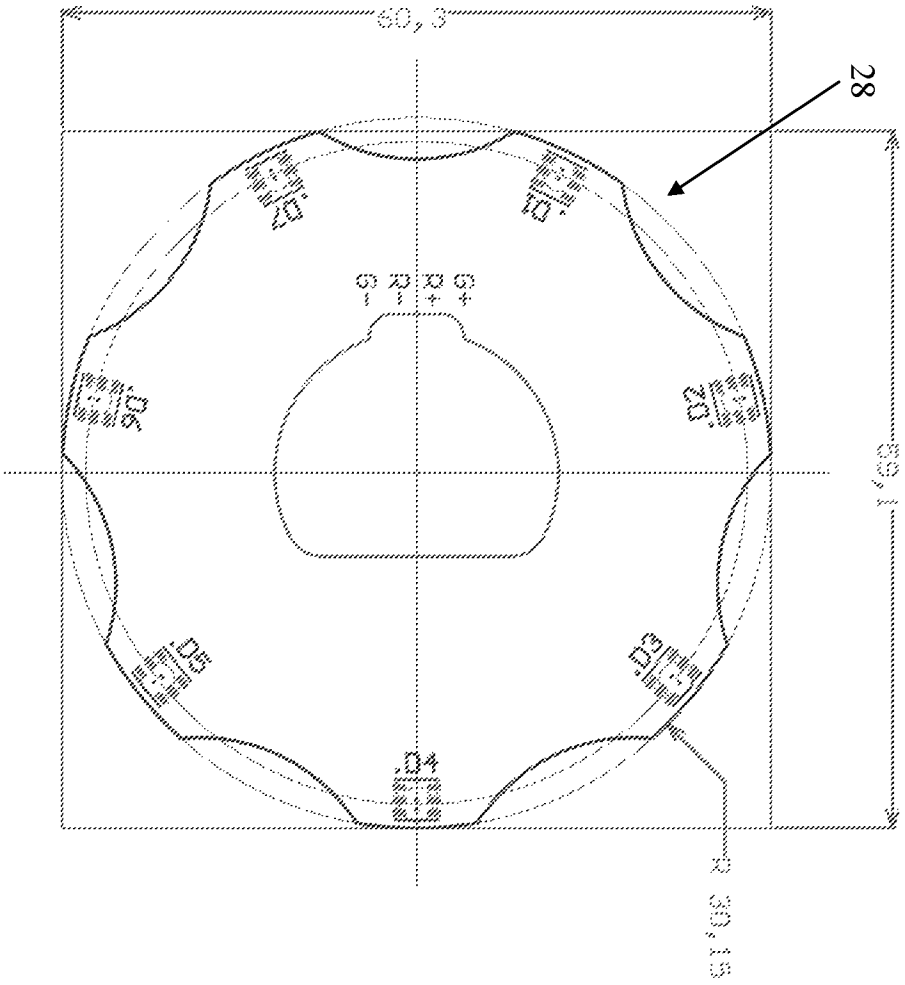
FIG. 3 schematically depicts an electronic board included in the knob according to FIG. 2.

FIG. 3 schematically illustrates the electronic board 28 as included in the knob 6 as described in FIG. 2. According to one embodiment, the electronic board 28 comprises seven dual-light emitting diodes D1, D2, D3, D4, D5, D5, D7. Depending on the bias voltage and hence the operating point of the dual-light emitting diodes D1, . . . , D7, the dual-light emitting diodes D1, . . . , D7 provide a green light or a red light. For supplying and controlling the dual-light emitting diodes D1, . . . , D7, four signals R+, R−, G+, G− are schematically indicated. According to one embodiment, the four signals R+, R−, G+, G− for controlling the dual-light emitting diodes D1, . . . , D7 are generated in a processor (not illustrated) on the electronic board 28 depending on the machine status value received via the cable connection 27. According to one embodiment, the four signals R+, R−, G+, G− for controlling the dual-light emitting diodes D1, . . . , D7 are generated in a processor (not illustrated) in the machine housing 2 depending on the machine status value and are provided to the electronic board 28 via a cable connection 27, e.g. a bus cable connection.

Figure 4:
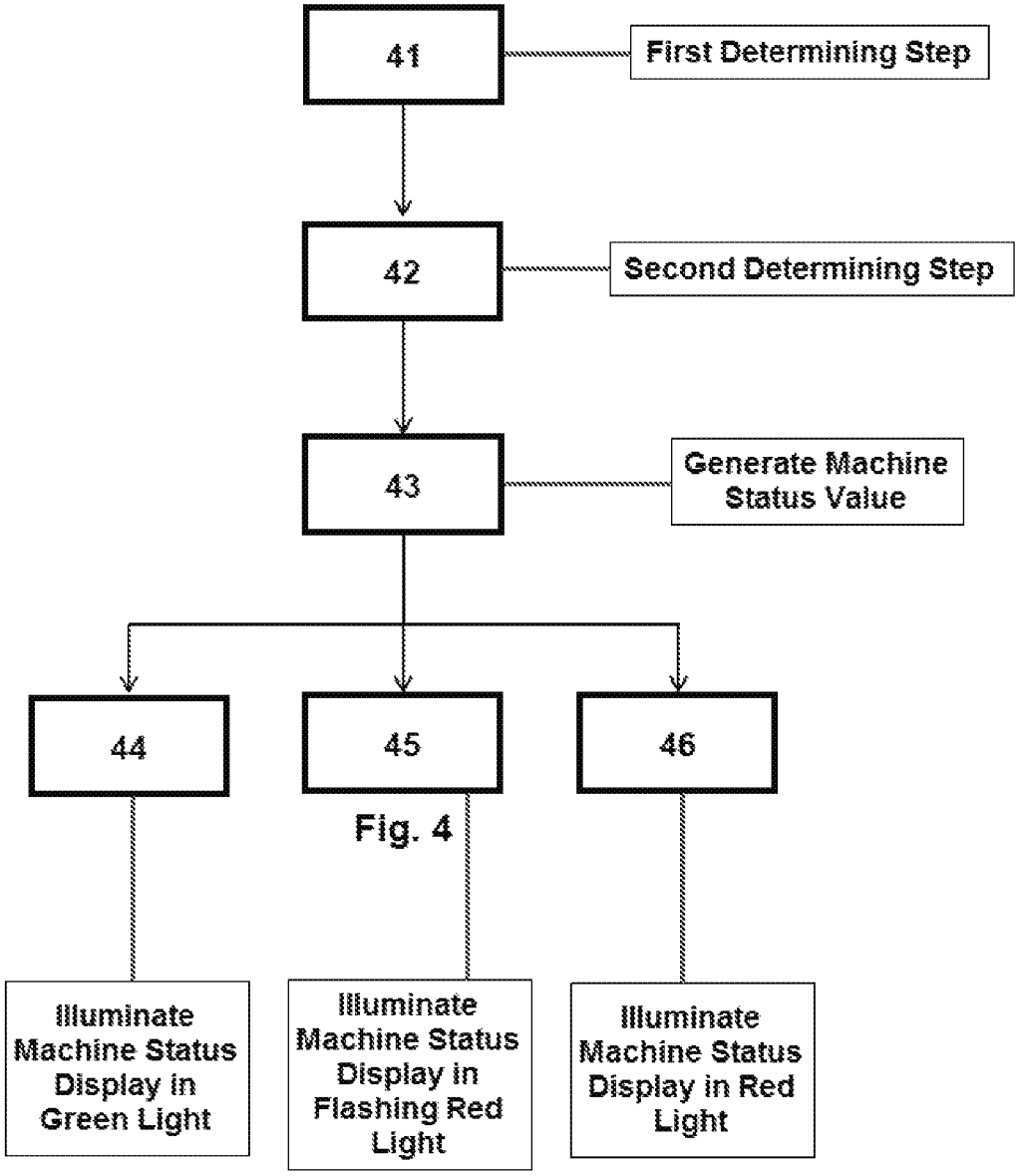
FIG. 4 schematically depicts a method according to an embodiment of the invention.

FIG. 4 schematically depicts a method according to the invention. In step 41, a blade state of the circular blade 3 is determined in a first determining step. The state of the blade 3 is either moving or not moving. In step 42, a state of the stop plate 5 is determined in a second determining step. The stop plate 5 is either in a zero position or not in a zero position. According to one embodiment, the state of the stop plate 5 represents the exact distance between the cutting plane and the surface of the stop plate 5. In step 43, a machine status value representing the state of the circular blade 3 and the state of the stop plate 5 is generated. The machine status value represents the safety status of the slicing machine 1. If the slicing machine 1 is in a safe state such that the stop plate 5 is in a zero position and the circular blade 3 is not moving, the machine status display is illuminated in green light in step 44, showing that the slicing machine 1 is in a safe state. If the slicing machine 1 is not in a safe state such that the stop plate 5 is not in a zero position and the circular blade 3 is not moving, the machine status display is flashing in red light in step 45, showing that the slicing machine 1 is not in a safe state. If the slicing machine 1 is not in a safe state such that the stop plate 5 is not in a zero position and the circular blade 3 is moving, the machine status display is illuminated in red light in step 46, showing that the slicing machine 1 is not in a safe state.

The functions of the various elements shown in the Figures, including any functional blocks, may be provided through the use of dedicated hardware as well as hardware capable of executing software in association with appropriate software. When provided by a processor, the functions may be provided by a single dedicated processor, by a single shared processor, or by a plurality of individual processors, some of which may be shared. Moreover, the functions may be provided, without limitation, by digital signal processor (DSP) hardware, network processor, application specific integrated circuit (ASIC), field programmable gate array (FPGA), read only memory (ROM) for storing software, random access memory (RAM), and non volatile storage. Other hardware, conventional and/or custom, may also be included.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

The invention claimed is:

1. A slicing machine for cutting slices of a food product, comprising:

a machine housing including a circular blade configured to rotate in a cutting plane;

a stop plate configured to be move, by an adjustment device, perpendicular to the cutting plane;

a carriage mounted such that it is movable parallel to the cutting plane;

a machine status display for displaying an actual status of the slicing machine;

a first sensor configured to determine if the blade is rotating;

a second sensor configured to determine the state of the stop plate; and a processor configured to receive outputs of the first sensor and the second sensor and to generate a machine status value.

2. A slicing machine according to claim 1, wherein the adjustment device is a knob comprising a transparent or translucent material, and wherein the machine status display is at least one light source integrated in the knob and configured to transmit light through the transparent or translucent material.

3. A slicing machine according to claim 2, further comprising a wire connection configured to provide signaling to and supplying of the at least one light source, wherein the wire is guided through an axis of a cam plate and through an inner area of the knob, and wherein an electronic board for controlling the at least one light source is located in the knob.

4. A slicing machine according to claim 3, wherein the wire is connected to the electronic board by sliding contacts or a rotatable connection.

5. A slicing machine according to claim 3, wherein the electronic board comprises seven dual-light emitting diodes arranged in circular and equidistant manner, each one providing light to an input of a light guiding structure, the light guiding structure being integrated in the transparent or translucent material of the knob and configured to fracture the light in a way that a homogeneous brightness is provided in a sector of the outer periphery of the knob.

6. A slicing machine according to claim 1, further comprising:

feet attached to the bottom of the slicing machine configured to set the slicing machine up on a flat surface, wherein the machine status display is integrated as at least one light source in the bottom side of the slicing machine and configured to transmit light onto the flat surface on which the slicing machine is set up.

7. A slicing machine according to claim 1, wherein the machine status display is integrated as at least one light source in a blade protection ring.

8. A slicing machine according to claim 1, wherein the machine status display is integrated as at least one light source in the carriage.

9. A slicing machine according to claim 2, wherein the at least one light source is a light emitting diode or dual-light emitting diode covered by a transparent or translucent material.

10. A slicing machine according to claim 1, wherein the machine status display is a fluorescent material covering at least part of the slicing machine.

11. A slicing machine according to claim 1, wherein the machine status display provides at least:

a first display mode for indicating that the stop plate is in a zero position and the circular blade is not moving, a second display mode for indicating that the stop plate is not in a zero position and the circular blade is not moving, and a third display mode for indicating that the stop plate is not in a zero position and the circular blade is moving.

12. A slicing machine according to claim 11, wherein the machine status display is illuminated green in the first display mode, wherein the machine status display is flashing red in the second display mode, and wherein the machine status display is illuminated red in the third display mode.

13. A method for operating a safety illumination display for a slicing machine for cutting slices of a food product, the method comprising:

determining a state of a circular blade;

determining a state of a stop plate;

generating a machine status value depending on the state of the circular blade and the state of the stop plate; and illuminating a machine status display depending on the machine status value.

14. A method for operating a safety illumination display for a slicing machine according to claim 13, wherein illuminating a machine status display depending on the machine status value comprises:

illuminating the machine status display in a first display mode if the circular blade is not moving and the stop plate is in a zero position;

illuminating the machine status display in a second display mode if the circular blade is not moving and the stop plate is not in a zero position; and illuminating the machine status display in a third display mode if the circular blade is moving and the stop plate is not in a zero position.

15. A method for operating a safety illumination display for a slicing machine according to claim 14, wherein the machine status display is illuminated green in the first display mode, wherein the machine status display is flashing red in the second display mode, and wherein the machine status display is illuminated red in the third display mode.

* * * * *